US008071924B2

(12) United States Patent
Lafferty

(10) Patent No.: US 8,071,924 B2
(45) Date of Patent: Dec. 6, 2011

(54) PACKAGE FOR BROWNING AND CRISPING DOUGH-BASED FOODS IN A MICROWAVE OVEN

(75) Inventor: Terrence P. Lafferty, Winneconne, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 209 days.

(21) Appl. No.: 12/319,537

(22) Filed: Jan. 8, 2009

(65) Prior Publication Data

US 2009/0120929 A1 May 14, 2009

Related U.S. Application Data

(62) Division of application No. 11/331,750, filed on Jan. 13, 2006, now Pat. No. 7,514,659.

(60) Provisional application No. 60/644,389, filed on Jan. 14, 2005.

(51) Int. Cl.
*H05B 6/80* (2006.01)

(52) U.S. Cl. ..... 219/730; 219/725; 219/728; 219/729; 426/107

(58) Field of Classification Search ..... 219/725–735, 219/759, 782; 426/107, 109, 118, 234, 243; 99/DIG. 14

See application file for complete search history.

(56) References Cited

U.S. PATENT DOCUMENTS

| | | | | |
|---|---|---|---|---|
| 4,260,060 | A | | 4/1981 | Faller |
| 4,267,420 | A | | 5/1981 | Brastad |
| 4,268,738 | A | | 5/1981 | Flautt, Jr. et al. |
| 4,279,933 | A | * | 7/1981 | Austin et al. ..... 426/124 |
| 4,286,136 | A | | 8/1981 | Mason, Jr. |
| 4,567,009 | A | | 1/1986 | Badenhop et al. |
| 4,626,641 | A | | 12/1986 | Brown |
| 4,678,882 | A | | 7/1987 | Bohrer et al. |
| 4,742,203 | A | | 5/1988 | Brown et al. |
| 4,745,249 | A | | 5/1988 | Daniels |
| 4,775,771 | A | | 10/1988 | Pawlowski et al. |
| 4,810,844 | A | | 3/1989 | Anderson |
| 4,835,352 | A | | 5/1989 | Sasaki et al. |
| 4,865,921 | A | | 9/1989 | Hollenberg et al. |
| 4,883,936 | A | | 11/1989 | Maynard et al. |
| 4,888,459 | A | | 12/1989 | Keefer |
| 4,890,439 | A | | 1/1990 | Smart |
| 4,894,247 | A | | 1/1990 | Fong |
| 4,894,503 | A | | 1/1990 | Wendt |
| 4,896,009 | A | | 1/1990 | Pawlowski |
| 4,916,280 | A | | 4/1990 | Havette |
| 4,927,991 | A | | 5/1990 | Wendt et al. |
| 4,933,193 | A | | 6/1990 | Fisher |

(Continued)

FOREIGN PATENT DOCUMENTS

EP 0563999 A2 10/1993

(Continued)

OTHER PUBLICATIONS

Notice of Allowance and Fee(s) Due for U.S. Appl. No. 11/712,294, dated Apr. 25, 2011.

*Primary Examiner* — Quang Van
(74) *Attorney, Agent, or Firm* — Womble Carlyle Sandridge & Rice, LLP

(57) ABSTRACT

Various constructs and systems for heating a dough-based food item in a microwave oven are provided.

34 Claims, 16 Drawing Sheets

U.S. PATENT DOCUMENTS

| | | | |
|---|---|---|---|
| 4,936,935 | A | 6/1990 | Beckett |
| 4,962,293 | A | 10/1990 | Lackey |
| 4,963,424 | A | 10/1990 | Beckett |
| 4,968,865 | A | 11/1990 | Seaborne et al. |
| 5,008,507 | A | 4/1991 | Pesheck et al. |
| 5,034,234 | A | 7/1991 | Andreas |
| 5,039,364 | A | 8/1991 | Beckett et al. |
| 5,041,325 | A | 8/1991 | Larson et al. |
| 5,053,594 | A | 10/1991 | Thota et al. |
| 5,081,330 | A | 1/1992 | Brandberg et al. |
| 5,084,601 | A | 1/1992 | Andreas |
| 5,096,723 | A | 3/1992 | Turpin |
| 5,117,078 | A | 5/1992 | Beckett |
| 5,140,119 | A | 8/1992 | Brown et al. |
| 5,164,562 | A | 11/1992 | Huffman et al. |
| 5,177,332 | A | 1/1993 | Fong |
| 5,213,902 | A | 5/1993 | Beckett |
| 5,217,768 | A | 6/1993 | Walters et al. |
| 5,221,419 | A | 6/1993 | Beckett |
| 5,231,268 | A | 7/1993 | Hall et al. |
| 5,239,153 | A | 8/1993 | Beckett |
| 5,247,149 | A | 9/1993 | Peleg |
| 5,256,846 | A | 10/1993 | Walters |
| 5,260,070 | A | 11/1993 | Peleg |
| 5,260,537 | A | 11/1993 | Beckett |
| 5,266,386 | A | 11/1993 | Beckett |
| 5,294,763 | A | 3/1994 | Chamberlain et al. |
| RE34,683 | E | 8/1994 | Maynard et al. |
| 5,334,820 | A | 8/1994 | Risch |
| 5,340,436 | A | 8/1994 | Beckett |
| 5,354,973 | A | 10/1994 | Beckett |
| 5,389,767 | A | 2/1995 | Dobry |
| 5,405,663 | A | 4/1995 | Archibald et al. |
| 5,410,135 | A | 4/1995 | Pollart et al. |
| 5,412,187 | A | 5/1995 | Walters et al. |
| 5,424,517 | A | 6/1995 | Habeger et al. |
| 5,484,984 | A | 1/1996 | Gics |
| 5,510,132 | A | 4/1996 | Gallo, Jr. |
| 5,519,195 | A | 5/1996 | Keefer et al. |
| 5,543,606 | A | 8/1996 | Gics |
| 5,565,125 | A | 10/1996 | Parks |
| 5,585,027 | A | 12/1996 | Young |
| 5,628,921 | A | 5/1997 | Beckett |
| 5,672,407 | A | 9/1997 | Beckett |
| 5,688,427 | A | 11/1997 | Gallo, Jr. |
| 5,698,127 | A | 12/1997 | Lai et al. |
| 5,759,422 | A | 6/1998 | Schmelzer et al. |
| 5,770,840 | A | 6/1998 | Lorence |
| 5,800,724 | A | 9/1998 | Habeger et al. |
| 5,864,123 | A | 1/1999 | Keefer |
| 5,910,268 | A | 6/1999 | Keefer |
| 5,948,308 | A | 9/1999 | Wischusen, III |
| 6,054,698 | A | 4/2000 | Mast |
| 6,114,679 | A | 9/2000 | Lai et al. |
| 6,133,560 | A | 10/2000 | Zeng et al. |
| 6,137,099 | A | 10/2000 | Hamblin |
| 6,150,646 | A | 11/2000 | Lai et al. |
| 6,158,589 | A | 12/2000 | Smith et al. |
| 6,168,812 | B1 | 1/2001 | Paulucci |
| 6,204,492 | B1 | 3/2001 | Zeng et al. |
| 6,251,451 | B1 | 6/2001 | Zeng |
| 6,359,272 | B1 | 3/2002 | Sadek et al. |
| 6,414,290 | B1 | 7/2002 | Cole et al. |
| 6,433,322 | B2 | 8/2002 | Zeng et al. |
| 6,455,827 | B2 | 9/2002 | Zeng |
| 6,501,059 | B1 | 12/2002 | Mast |
| 6,534,755 | B1 | 3/2003 | Paulucci |
| 6,552,315 | B2 | 4/2003 | Zeng et al. |
| 6,559,430 | B2 | 5/2003 | Monforton et al. |
| 6,677,563 | B2 | 1/2004 | Lai |
| 6,717,121 | B2 | 4/2004 | Zeng et al. |
| 6,765,182 | B2 | 7/2004 | Cole et al. |
| 7,019,271 | B2 | 3/2006 | Wnek |
| 7,514,659 | B2 | 4/2009 | Lafferty |
| 2001/0017297 | A1 | 8/2001 | Zeng et al. |
| 2001/0021405 | A1 | 9/2001 | Zeng |
| 2002/0144996 | A1 | 10/2002 | Zeng et al. |
| 2003/0010777 | A1 | 1/2003 | Milgrom |
| 2003/0085224 | A1 | 5/2003 | Tsontzidis et al. |
| 2003/0111463 | A1 | 6/2003 | Lai |
| 2003/0116562 | A1 | 6/2003 | Halimi et al. |
| 2003/0206997 | A1 | 11/2003 | Winkelman et al. |
| 2004/0149746 | A1 | 8/2004 | Hoese et al. |
| 2004/0173607 | A1 | 9/2004 | Blankenbeckler et al. |
| 2004/0232213 | A1 | 11/2004 | Pope |
| 2005/0042360 | A1 | 2/2005 | Tiffany et al. |
| 2006/0049190 | A1 | 3/2006 | Middleton |
| 2006/0113300 | A1 | 6/2006 | Wnek |
| 2006/0289521 | A1 | 12/2006 | Bohme et al. |
| 2007/0056962 | A1 | 3/2007 | Hopkins et al. |
| 2007/0087090 | A1 | 4/2007 | Russell et al. |
| 2007/0228036 | A1 | 10/2007 | Noyelle et al. |
| 2007/0251943 | A1 | 11/2007 | Wnek et al. |
| 2008/0023469 | A1 | 1/2008 | Fitzwater |
| 2010/0038359 | A1 | 2/2010 | Laubhan |

FOREIGN PATENT DOCUMENTS

| | | | |
|---|---|---|---|
| EP | 0 656 301 | A1 | 6/1995 |
| EP | 0 970 895 | A1 | 1/2000 |
| EP | 1840047 | | 10/2007 |
| FR | 2 828 394 | | 2/2003 |
| JP | 62-191682 | | 12/1987 |
| JP | 9-132279 | | 5/1997 |
| JP | 9-185991 | | 7/1997 |
| WO | WO 92/00899 | | 1/1992 |
| WO | WO 97/11010 | | 3/1997 |
| WO | WO 89/04585 | | 5/1998 |
| WO | WO 03/066435 | | 8/2003 |
| WO | WO 2005/085091 | A2 | 9/2005 |
| WO | WO 2006/076501 | A1 | 7/2006 |
| WO | WO 2006/130789 | A1 | 12/2006 |
| WO | WO 2007/123611 AI | | 11/2007 |
| WO | WO 2008/014377 AI | | 1/2008 |
| WO | WO 2008/052096 | A1 | 5/2008 |
| WO | WO 2008/115272 | A2 | 9/2008 |
| WO | WO 2010/019758 | A2 | 2/2010 |

* cited by examiner

PACKAGE FOR BROWNING AND CRISPING DOUGH-BASED FOODS IN A MICROWAVE OVEN

CROSS-REFERENCE TO RELATED APPLICATIONS

This application is a divisional application of U.S. patent application Ser. No. 11/331,750, filed Jan. 13, 2006, now U.S. Pat. No. 7,514,659, which claims the benefit of U.S. Provisional Application No. 60/644,389, filed Jan. 14, 2005, both of which are incorporated by reference in their entirety.

FIELD OF THE INVENTION

The present invention relates to packages, constructs, and systems for heating or cooking a microwavable food item. In particular, the invention relates to various packages, constructs, and systems for heating or cooking a food item having a dough or crust in a microwave oven.

BACKGROUND

Microwave ovens provide a convenient means for heating a variety of food items, including dough-based products such as pizzas and pies. However, microwave ovens tend to cook such items unevenly and are unable to achieve the desired balance of thorough heating and a browned, crisp crust. Additional complications are encountered with rising dough products, as the package must promote browning and crisping, typically by maintaining surface contact with the food, without restricting the natural expansion of the dough during the cooking process. Thus, there is a need for a microwave cooking package for a dough-based food item that provides the desired degree of heating, browning, and crisping without restricting the expansion of the dough.

SUMMARY

Various packages, trays, sleeves, other constructs, and systems for heating a food item in a microwave oven are contemplated. In one aspect, a construct or system according to the present invention includes features, components, or elements that provide enhanced browning and crisping of a dough-based food item without impeding expansion of the rising dough. Other aspects, features, and advantages of the present invention will become apparent from the following description and accompanying figures.

BRIEF DESCRIPTION OF THE DRAWINGS

The description refers to the accompanying drawings in which like reference characters refer to like parts throughout the several views, and in which.

DETAILED DESCRIPTION

Figure 1:
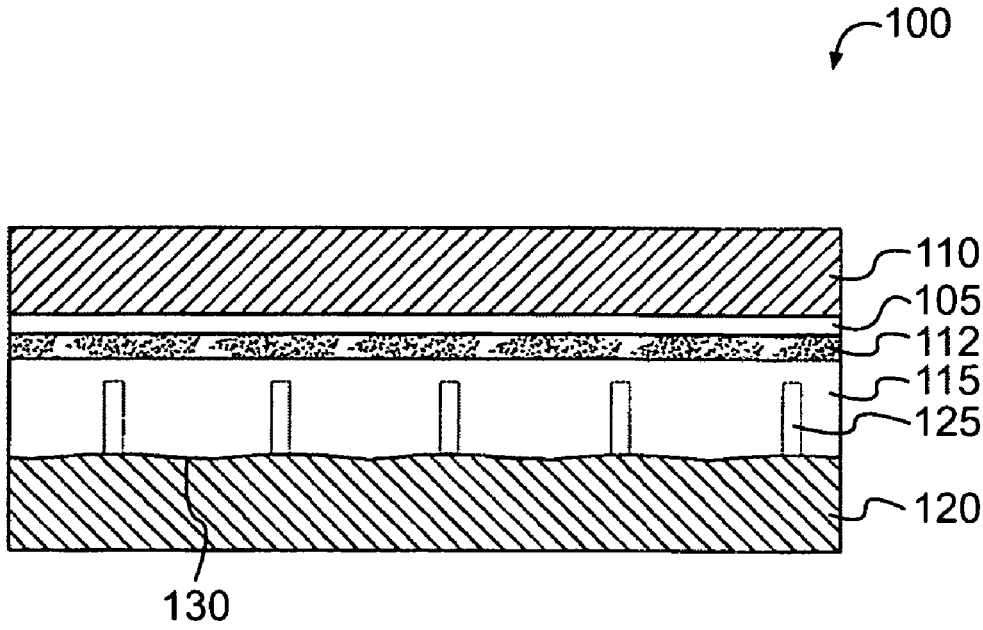
FIG. 1 is a cross-sectional view of an insulating microwave material that may be used according to various aspects of the present invention.

The present invention generally is directed to a cooking package, for example, a tray, sleeve, or other construct (collectively "package" or "construct") for heating or cooking a food item. As used herein, the terms "cooking" and "heating" shall be used interchangeably to refer to the application of heat to a food item to render it suitable or desirable for consumption by a human or animal.

In one aspect, the present invention is directed to a one-piece, integral construct for heating or cooking a food item. The construct provides uniform heating, browning, and crisping of a dough-based food item, for example, a pizza or pastry. Unlike many two-piece systems that require the user to adjust the pieces to position the microwave active heating element properly, the construct of the present invention is easier to position the food item in and use.

The construct of the present invention generally includes a base having a food-supporting or food-bearing surface on which the food item is positioned, and a cover attached to the base. The cover may include a food-exposing opening defined by an inside edge and a peripheral cover portion. The opening may be circular or any other shape as needed or desired for a particular application. The cover includes a food-contacting side or interior surface that is capable of contacting at least partially the dough portion, for example, the crust of a food item. For example, where the food item is pizza, at least a portion of the interior surface of the cover contacts the portion of the dough not covered with sauce or toppings. In the case of a pastry, such as a bottom crusted fruit pie, the periphery contacts the portion of the dough not filled with fruit or other confections. The contact may be intimate, proximate, or a combination thereof. After the food item is cooked, the outermost portion or perimeter of a dough-based food item is commonly referred to as a "crust". However, the term "crust" is used herein to refer to the outermost portion or perimeter of the dough prior to, during, and after cooking.

Optionally, the cover includes a plurality of slits extending outwardly from the opening and normal to the inside edge of the cover. The slits form a plurality of resilient, deformable tabs that may contact intimately a substantial portion of the typically non-uniform surface of the crust. The tabs are capable of deflecting away from the base in response to a deflecting force applied thereto. Additionally, the tabs exert a downward force on the crust, thereby maintaining contact between the tabs and the crust as the dough expands and browns. Notably, the tabs do not restrict expansion of the dough. Additionally, moisture may be vented through the slits to aid in crisping. Thus, the resulting food item is similar to that obtained by cooking the food item in a conventional oven.

One or both of the integral base and cover may include one or more features that enhance the heating or cooking of the food item. For example, one or both of the base and cover may be formed at least partially from one or more microwave energy interactive materials that promote browning and/or crisping of the food item during microwave heating. Depending on the microwave energy interactive material selected and its positioning in the packaging, the microwave energy interactive feature may absorb microwave energy, transmit microwave energy, or reflect microwave energy, as needed or desired for a particular food item.

In one aspect, the microwave energy active feature is a susceptor material. A susceptor material used in accordance with the present invention may comprise a microwave energy interactive material deposited on or supported by a substrate. The microwave energy interactive material may comprise an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste; or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination thereof.

While metals are inexpensive and easy to obtain in both vacuum deposited or foil forms, metals may not be suitable for every application. For example, in high vacuum deposited thickness and in foil form, metals are opaque to visible light and may not be suitable for forming a clear microwave package or component. Further, the interactive properties of such vacuum deposited metals for heating often are limited to heating for narrow ranges of heat flux and temperature. Such materials therefore may not be optimal for heating, browning, and crisping all food items. Additionally, for field management uses, metal foils and vacuum deposited coatings can be difficult to handle and design into packages, and can lead to arcing at small defects in the structure.

If desired, the microwave interactive energy material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, or a combination thereof. To form the susceptor, ITO typically is sputtered onto a clear polymeric film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Use of ITO in the construct of the present invention may provide additional benefits when compared with other, non-transparent microwave energy interactive materials. A clear, transparent package construction would allow the consumer to see the dough rise and brown while the food item cooks in the microwave oven. Thus, the consumer can monitor the cooking process without having to interrupt the cooking cycle. In one variation of this aspect, the susceptor is formed from ITO sputtered PET film that is laminated to a clear, low thermal shrink PET extruded sheet having a thickness of at least about 0.005 inches. The term "low thermal shrink" typically is used to refer to a material that shrinks less than about 10%, for example, less than about 2% at 350° F.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

The substrate used in accordance with the present invention typically comprises an electrical insulator, for example, a polymeric film. The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymeric films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one aspect, the polymeric film comprises polyethylene terephthalate. Examples of polyethylene terephthalate films that may be suitable for use as the substrate include, but are not limited to, MELINEX®, commercially available from DuPont Teijan Films (Hopewell, Va.), and SKYROL, commercially available from SKC, Inc. (Covington, Ga.). Polyethylene terephthalate films are used in commercially available susceptors, for example, the QWIK WAVE® Focus susceptor and the MICRO-RITE® susceptor, both available from Graphic Packaging International (Marietta, Ga.).

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating, circles, loops, hexagons, islands, squares, rectangles, octagons, and so forth. Examples of alternative patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of the microwave energy interactive material are shown and described herein, it should be understood that other patterns of microwave energy interactive material are contemplated by the present invention.

The susceptor then may be laminated to a flexible, semi-rigid, or substantially rigid supporting material, for example, a paper, paperboard, or cardboard. In one aspect, the support is a paper generally having a basis weight of from about 15 to about 60 lbs/ream, for example, from about 20 to about 40 lbs/ream. In one particular example, the paper has a basis weight of about 25 lbs/ream. In another aspect, the support is a paperboard having a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International. If needed or desired, one or more portions of the blank may be laminated to or coated with one or more different or similar sheet-like materials at selected panels or panel sections.

Alternatively, one or both of the base and cover may be formed at least partially from one or more insulating microwave materials. As used herein, an "insulating microwave material" refers to any arrangement of layers, such as susceptor layers, polymer layers, paper layers, continuous and discontinuous adhesive layers, and patterned adhesive layers that provide an insulating effect. The insulating microwave material may include one or more susceptors, one or more expandable insulating cells, or a combination of susceptors and expandable insulating cells. By using an insulating microwave material in cooperation with a susceptor, more of the sensible heat generated by the susceptor is transferred to the surface of the food item rather than to the microwave oven environment. Without the insulating material, some or all the heat generated by the susceptor may be lost via conduction to the surrounding air and other conductive media, such as the microwave oven floor or turntable. Thus, more of the sensible heat generated by the susceptor is directed to the food item and browning and crisping is enhanced. Furthermore, insulating microwave materials may retain moisture in the food item when cooking in the microwave oven, thereby improving the texture and flavor of the food item. Examples of materials that may be suitable, alone or in combination, include, but are not limited to, are QwikWave® Susceptor packaging material, QwikWave® Focus® packaging material, Micro-Rite® packaging material, MicroFlex® Q packaging material, and QuiltWave™ Susceptor packaging material, each of which is commercially available from Graphic Packaging International, Inc. Examples of such materials are described in PCT Publication No. WO 03/066435, incorporated by reference herein in its entirety.

If desired, multiple layers of insulating microwave materials may be used to enhance the insulating properties of the construct and, therefore, browning and crisping of the food item. Where multiple layers are used, the layers may remain separate or may be joined using any suitable process or technique, for example, thermal bonding, adhesive bonding, ultrasonic bonding or welding, mechanical fastening, or any combination thereof. In one example, two sheets of an insulating microwave material are arranged so that their respective susceptor layers are facing away from each other. In another example, two sheets of an insulating microwave material are arranged so that their respective susceptor layers are facing towards each other. In still another example, multiple sheets of an insulating microwave material are arranged in a like manner and superposed. In a still further example, multiple sheets of various materials are superposed in any other configuration as needed or desired for a particular application. The multi-layer material then can be used to form, or can be used in cooperation with, a construct according to the present invention. However, while such uses are described herein, it will be understood that such multi-layer insulating materials may be used independently to heat, brown, and crisp dough-based food items.

Various exemplary insulating materials are depicted in FIGS. 1-6. In each of the examples shown herein, it should be understood that the layer widths are not necessarily shown in perspective. In some instances, for example, the adhesive layers may be very thin with respect to other layers, but are nonetheless shown with some thickness for purposes of clearly illustrating the arrangement of layers.

Referring to FIG. 1, the material 100 may be a combination of several different layers. A susceptor, which typically includes a thin layer of microwave interactive material 105 on a first plastic film 110, is bonded for example, by lamination with an adhesive 112, to a dimensionally stable substrate 115, for example, paper. The substrate 115 is bonded to a second plastic film 120 using a patterned adhesive 125 or other material, such that closed cells 130 are formed in the material 100. The closed cells 130 are substantially resistant to vapor migration.

Figure 2:
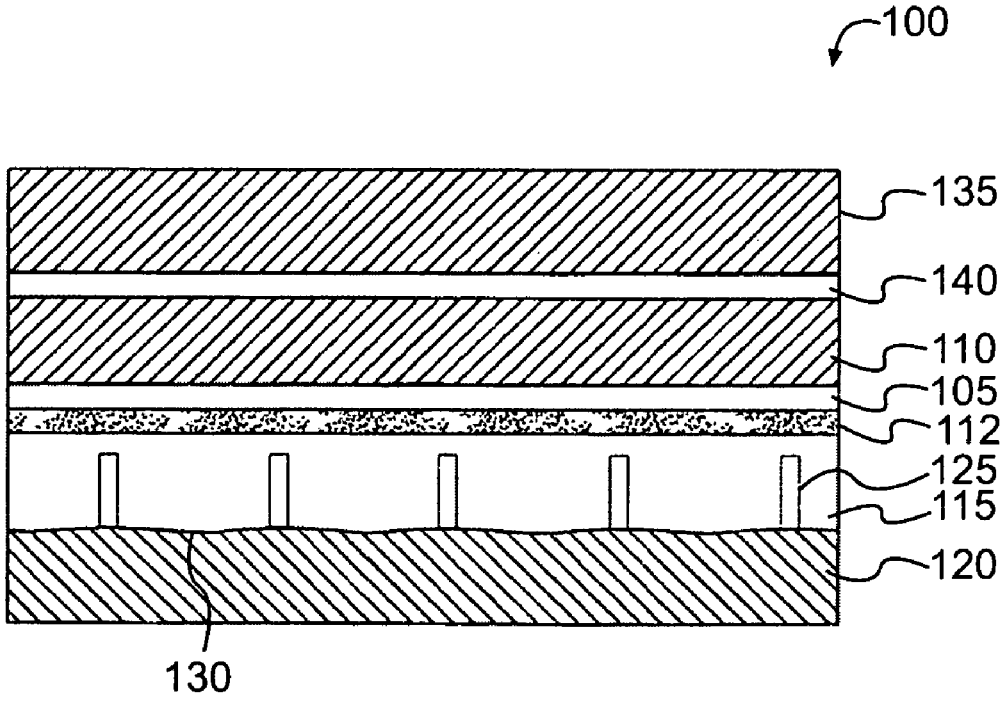
FIG. 2 is a cross-sectional view of an alternative insulating microwave material that may be used according to various aspects of the present invention.

Optionally, an additional substrate layer 135 may be adhered by adhesive 140 or otherwise to the first plastic film 110 opposite the microwave interactive material 105, as depicted in FIG. 2. The additional substrate layer 135 may be a layer of paper or any other suitable material, and may be provided to shield the food item (not shown) from any flakes of susceptor film that craze and peel away from the substrate during heating. The insulating material 100 provides a substantially flat, multi-layered sheet 150, as shown in FIG. 3.

Figure 3:
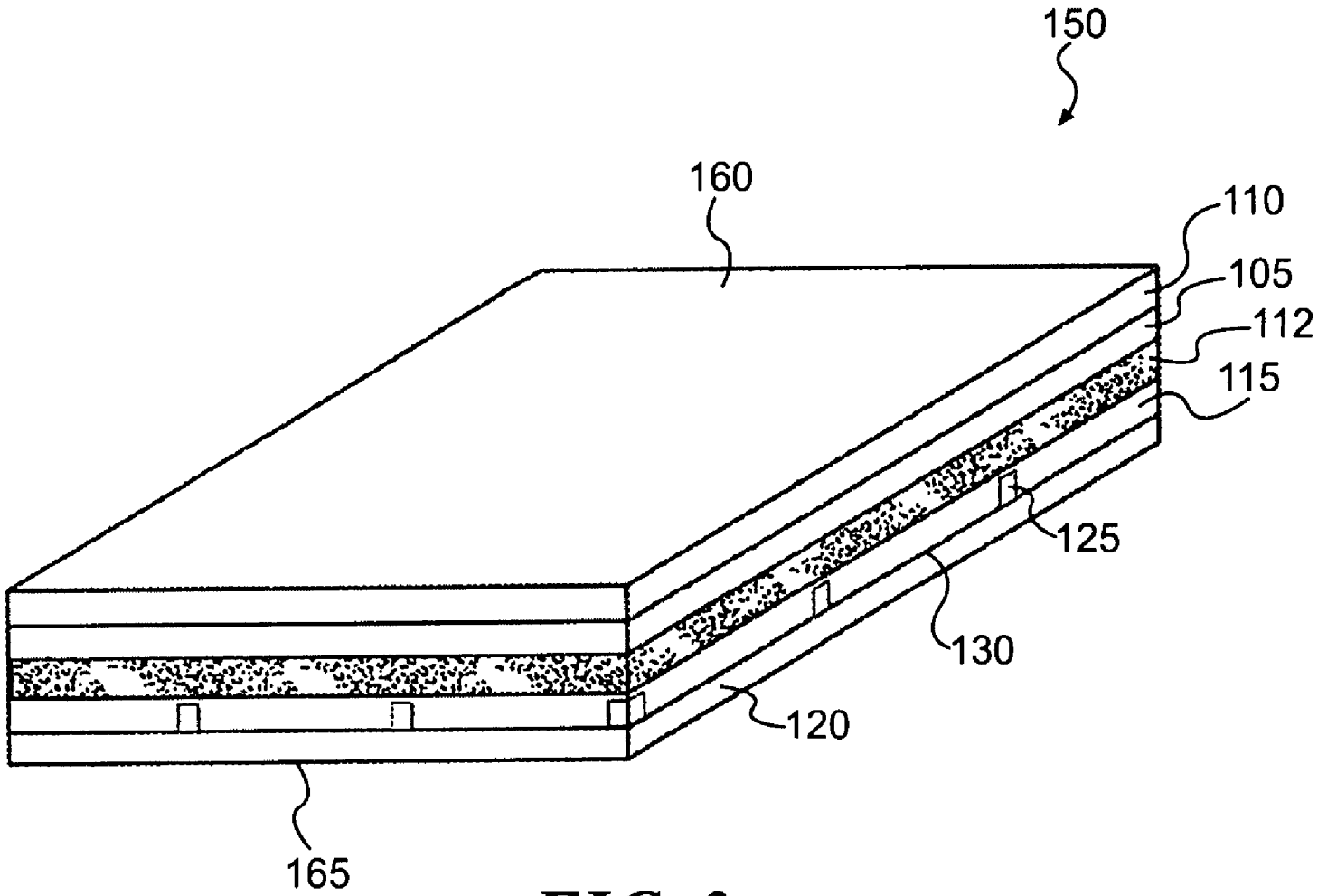
FIG. 3 is a perspective view of the insulating microwave material of FIG. 1.
Figure 4:
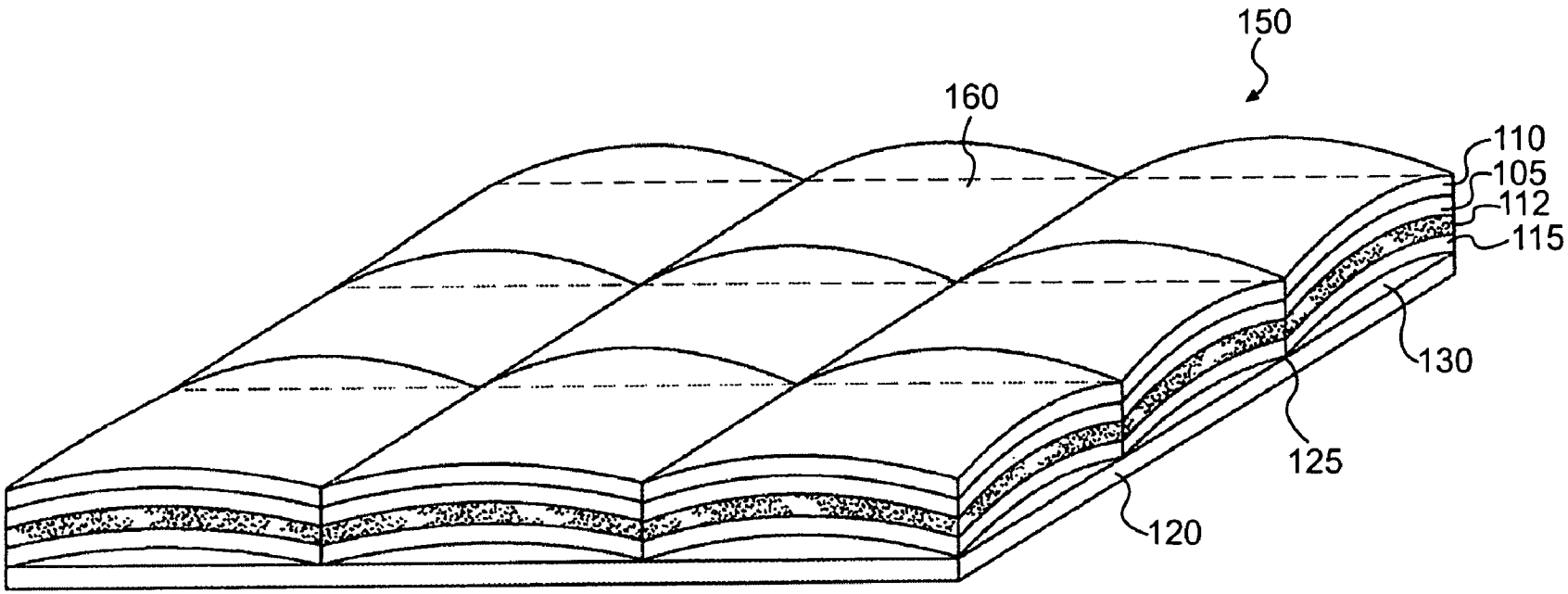
FIG. 4 depicts the insulating microwave material of FIG. 3 after exposure to microwave energy.

FIG. 4 depicts the exemplary insulating material 150 of FIG. 3 after being exposed to microwave energy from a microwave oven (not shown). As the susceptor heats upon impingement by microwave energy, water vapor and other gases normally held in the substrate 115, for example, paper, and any air trapped in the thin space between the second plastic film 120 and the substrate 115 in the closed cells 130, expand. The expansion of water vapor and air in the closed cells 130 applies pressure on the susceptor film 110 and the substrate 115 on one side and the second plastic film 120 on the other side of the closed cells 130. Each side of the material 100 forming the closed cells 130 reacts simultaneously, but uniquely, to the heating and vapor expansion. The cells 130 expand or inflate to form a quilted top surface 160 of pillows separated by channels (not shown) in the susceptor film 110 and substrate 115 lamination, which lofts above a bottom surface 165 formed by the second plastic film 120. This expansion may occur within 1 to 15 seconds in an energized microwave oven, and in some instances, may occur within 2 to 10 seconds.

Figure 5:
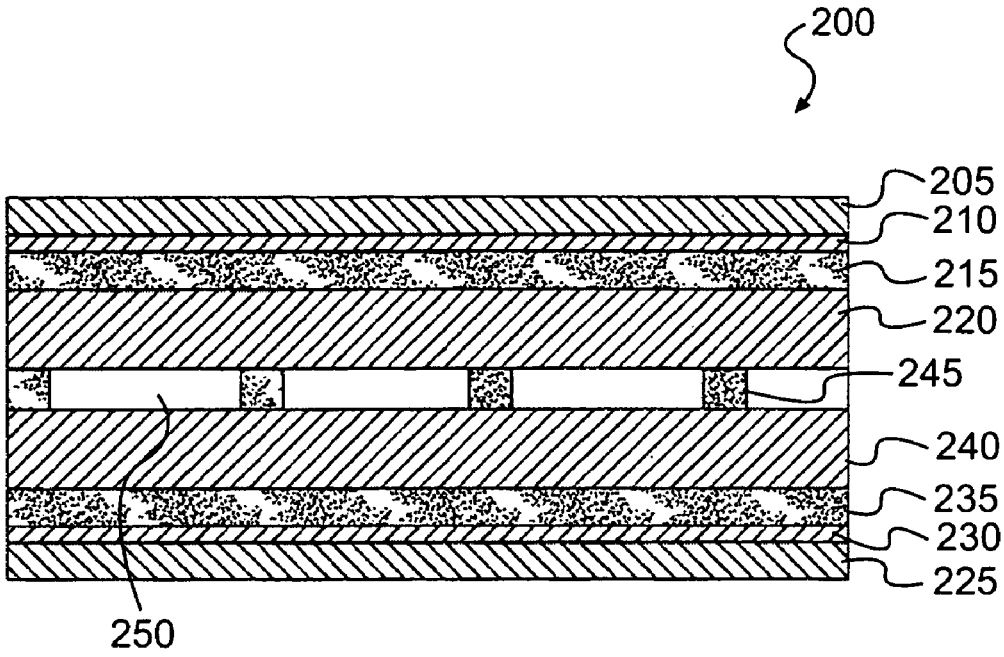
FIG. 5 is a cross-sectional view of yet another insulating microwave material that may be used according to various aspects of the present invention.
Figure 6:
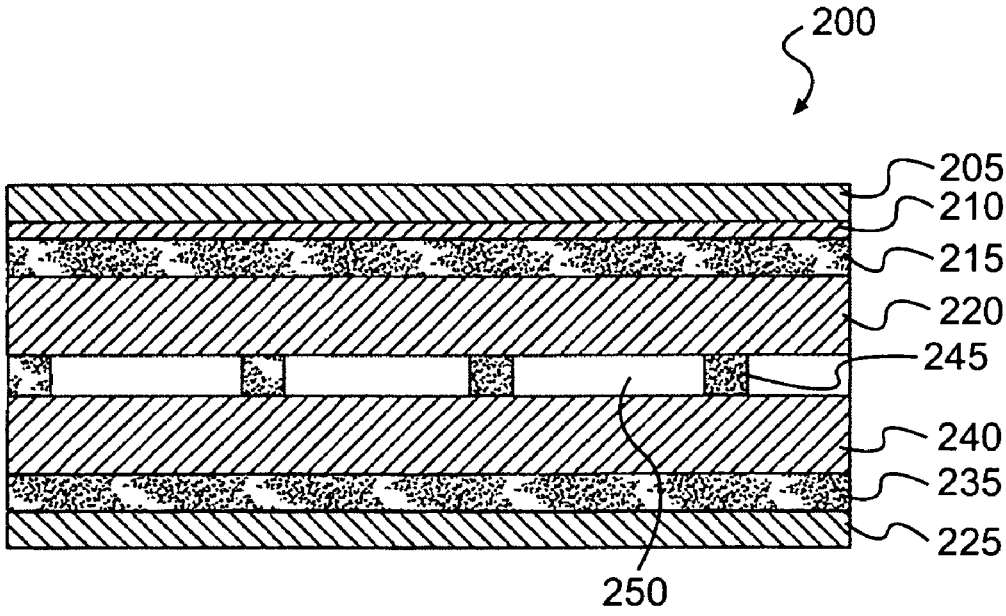
FIG. 6 is a cross-sectional view of still another insulating microwave material that may be used according to various aspects of the present invention.

FIGS. 5 and 6 depict alternative exemplary microwave insulating material layer configurations that may be suitable for use with any of the various packages of the present invention. Referring first to FIG. 5, an insulating microwave material 200 is shown with two symmetrical layer arrangements adhered together by a patterned adhesive layer. The first symmetrical layer arrangement, beginning at the top of the drawings, comprises a PET film layer 205, a metal layer 210, an adhesive layer 215, and a paper or paperboard layer 220. The metal layer 210 may comprise a metal, such as aluminum, deposited along at least a portion of the PET film layer 205. The PET film 205 and metal layer 210 together define a susceptor. The adhesive layer 215 bonds the PET film 205 and the metal layer 210 to the paperboard layer 220.

The second symmetrical layer arrangement, beginning at the bottom of the drawings, also comprises a PET film layer 225, a metal layer 230, an adhesive layer 235, and a paper or paperboard layer 240. If desired, the two symmetrical arrangements may be formed by folding one layer arrangement onto itself. The layers of the second symmetrical layer arrangement are bonded together in a similar manner as the layers of the first symmetrical arrangement. A patterned adhesive layer 245 is provided between the two paper layers 220 and 240, and defines a pattern of closed cells 250 configured to expand when exposed to microwave energy. In one aspect, an insulating material 200 having two metal layers 210 and 230 according to the present invention generates more heat and greater cell loft.

Referring to FIG. 6, yet another insulating microwave material 200 is shown. The material 200 may include a PET film layer 205, a metal layer 210, an adhesive layer 215, and a paper layer 220. Additionally, the material 200 may include a clear PET film layer 225, an adhesive 235, and a paper layer 240. The layers are adhered or affixed by a patterned adhesive 245 defining a plurality of closed expandable cells 250.

It will be understood by those of skill in the art that in any of the packages contemplated hereby, the microwave insulating material may include an adhesive pattern that is selected to enhance cooking of a particular food item. For example, where the food item is a single item, for example, a pizza, the adhesive pattern may be selected to form substantially uniformly shaped expandable cells. Where the food item is a plurality of small items, for example, small pastries, the adhesive pattern may be selected to form a plurality of different sized cells to allow the individual items to be variably contacted on their various surfaces. While various examples are provided herein, it will be understood that numerous patterns are contemplated hereby, and the pattern selected will depend on the heating, browning, crisping, and insulating needs of the particular food item and package.

Furthermore, any of the various constructs of the present invention may include one or more apertures. The number, shape, size, and positioning of such apertures may vary for a particular application depending on type of construct, the food item to be heated therein or thereon, the desired degree of browning and/or crisping, whether direct exposure to microwave energy is needed or desired to attain uniform heating of the food item, the need for regulating the change in temperature of the food item through direct heating, and whether and to what extent there is a need for further venting.

The aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, where a microwave energy interactive material is used to form at least a portion of the construct, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to escape from the interior of the construct.

Any of the various constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. Patent Application Publication No. US 2006/0049190 A1, published Mar. 9, 2006, both of which are incorporated herein by reference in their entirety. Additionally, the blank or construct may include graphics or indicia printed thereon.

Optionally, one or more portions or panels of the constructs described herein or contemplated hereby may be coated with varnish, clay, or other materials, either alone or in combination. The coating may then be printed over with product, advertising, and other information or images. The constructs also may be coated to protect any information printed thereon. The constructs also may be provided with, for example, a moisture barrier layer, on either or both sides.

EXAMPLE CONSTRUCTS

Various aspects of the invention may be illustrated further by referring to the figures. For purposes of simplicity, like numerals may be used to describe like features. It will be understood that where a plurality of similar features are depicted, not all of such features are necessarily labeled on each figure.

While various exemplary embodiments are shown and described in detail herein, it also will be understood that any of the features may be used in any combination, and that such combinations are contemplated hereby. For instance, in the examples shown herein, the construct is somewhat circular or square in shape with a somewhat circular opening, suitable, for example, for heating a pizza therein. However, it will be understood that in this and other aspects of the invention described herein or contemplated hereby, numerous shapes and configurations may be used to form the various constructs. Examples of other shapes encompassed hereby include, but are not limited to, polygons, rectangles, ovals, cylinders, prisms, spheres, polyhedrons, and ellipsoids. The shape of the construct may be determined largely by the shape of the food item, and it should be understood that different packages are contemplated for different food items, for example, sandwiches, pizzas, soft pretzels, pastries, doughs, and so forth. Likewise, the constructs may include gussets, pleats, or any other feature needed or desired to accommodate a particular food item and/or portion size. Additionally, it will be understood that the present invention contemplates constructs for single-serving portions and for multiple-serving portions.

Turning to FIGS. 7-10, a cooking package in the form of a sleeve 300 is provided. The sleeve 300 includes a base 305 and a cover 310 formed from a susceptor material laminated to paperboard. The cover 310 includes a generally centrally positioned opening 315 defined by an inside edge 320. A plurality of slits 325 extend from the inside edge 320 toward an outside edge 330 of the periphery 335, thereby forming a plurality of tabs 340. The slits 325 may extend any distance from the inside edge 320 toward the outside edge 330 of the peripheral portion 335 of the cover 310 as needed for a given application. For example, the slits 325 may be extended where the dough is expected to expand significantly.

Turning to FIGS. 8A-8D, as the food item F cooks and the dough 345 rises, the tabs 340 are forced by the rising dough or crust C in an upward and outward direction R1. The tabs 340 do not restrict the natural rise of the crust C. At the same time, the memory in the paperboard causes the tabs 340 to exert a force on the dough or crust C in a direction R2. By providing tabs 340 in this manner, the crust C is in substantially continuous, substantially intimate contact with the susceptor material on the tabs 340 during both cooking and browning. Additionally, moisture (not shown) is allowed to vent through the slits 325, thereby enhancing crisping of the crust C.

Figure 7:
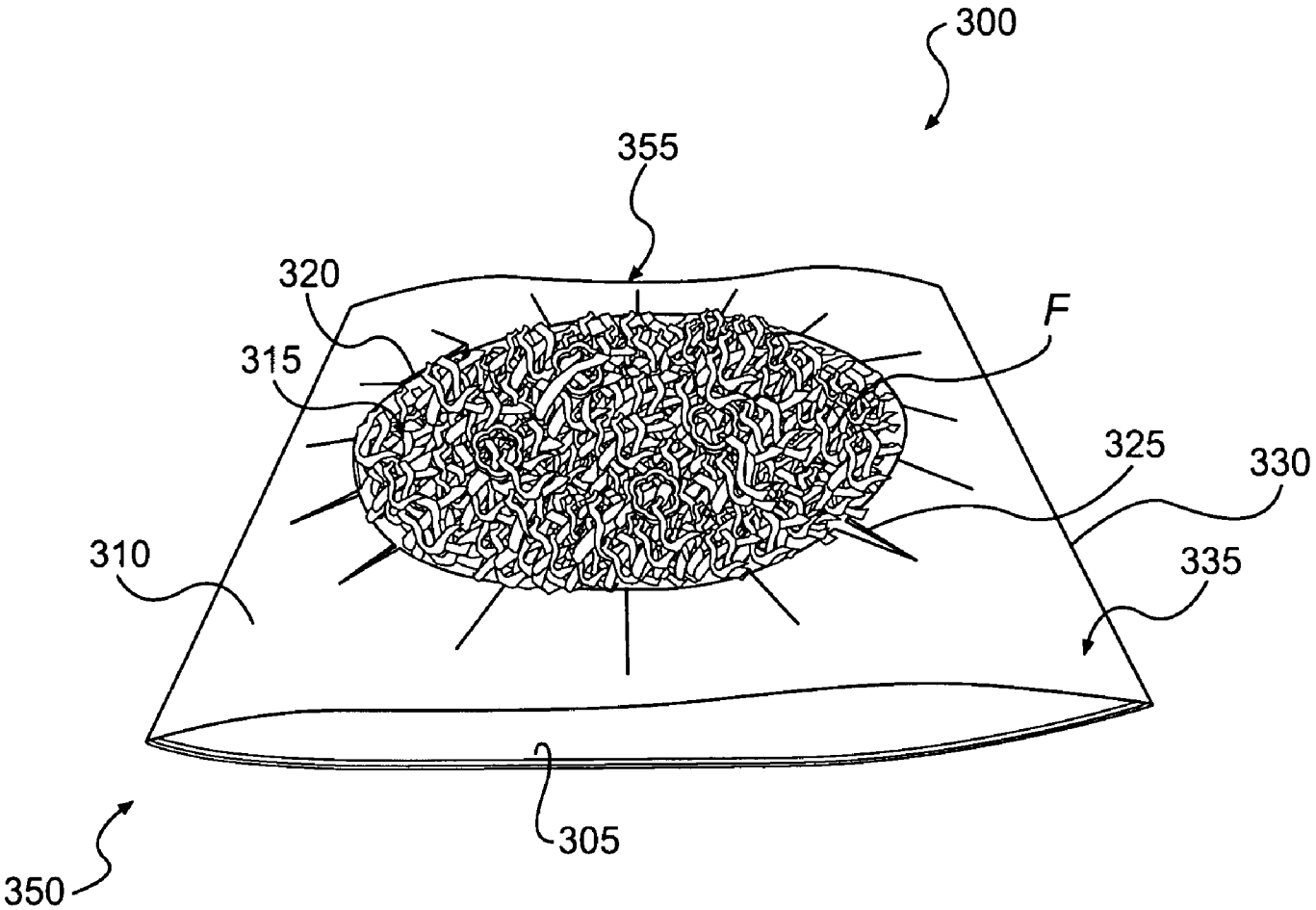
FIG. 7 depicts an exemplary microwave cooking construct in the form of a sleeve according to various aspects of the present invention.
Figure 8A:
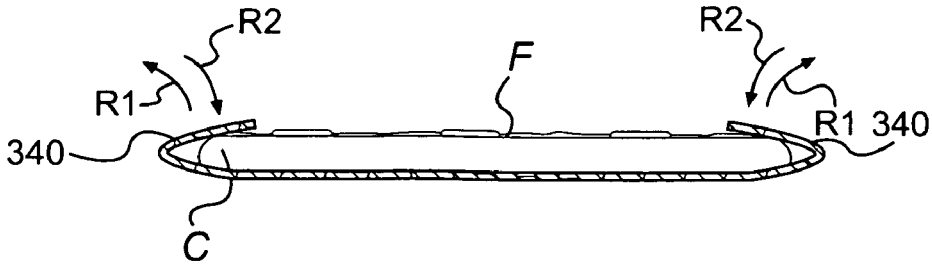
FIGS. 8A-8D are schematic representations of the sleeve of FIG. 7 in use.
Figure 8B:
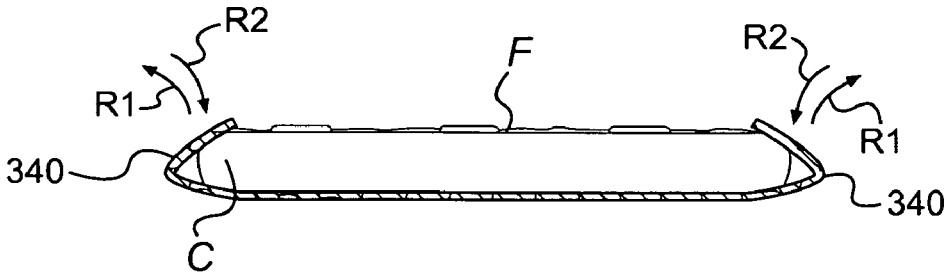
Figure 8C:
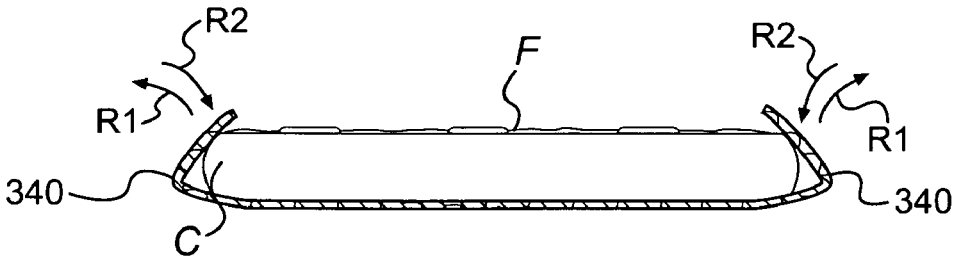
Figure 8D:
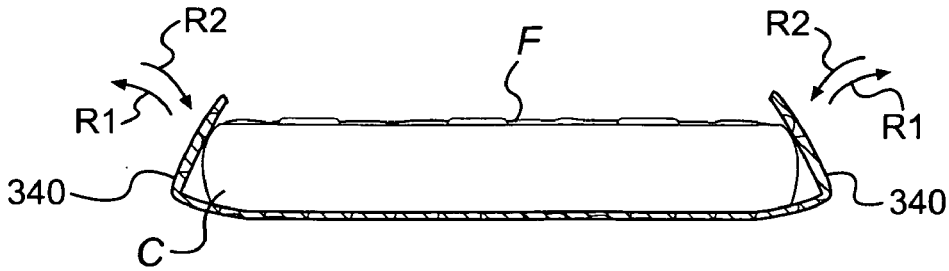
Figure 9:
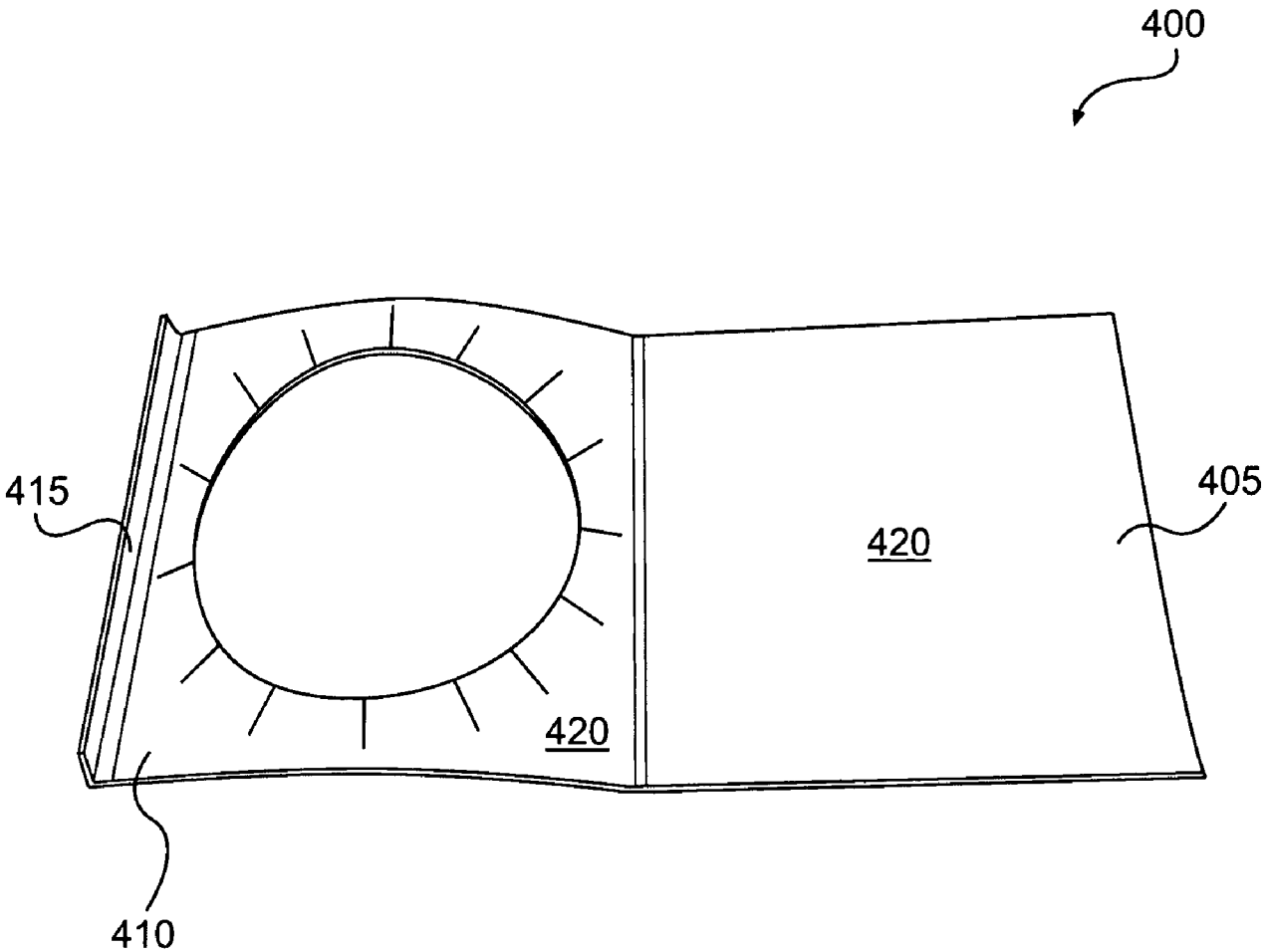
FIG. 9 depicts another exemplary construct according to various aspects of the present invention in the form of a sleeve, where the sleeve is in an open condition.
Figure 10:
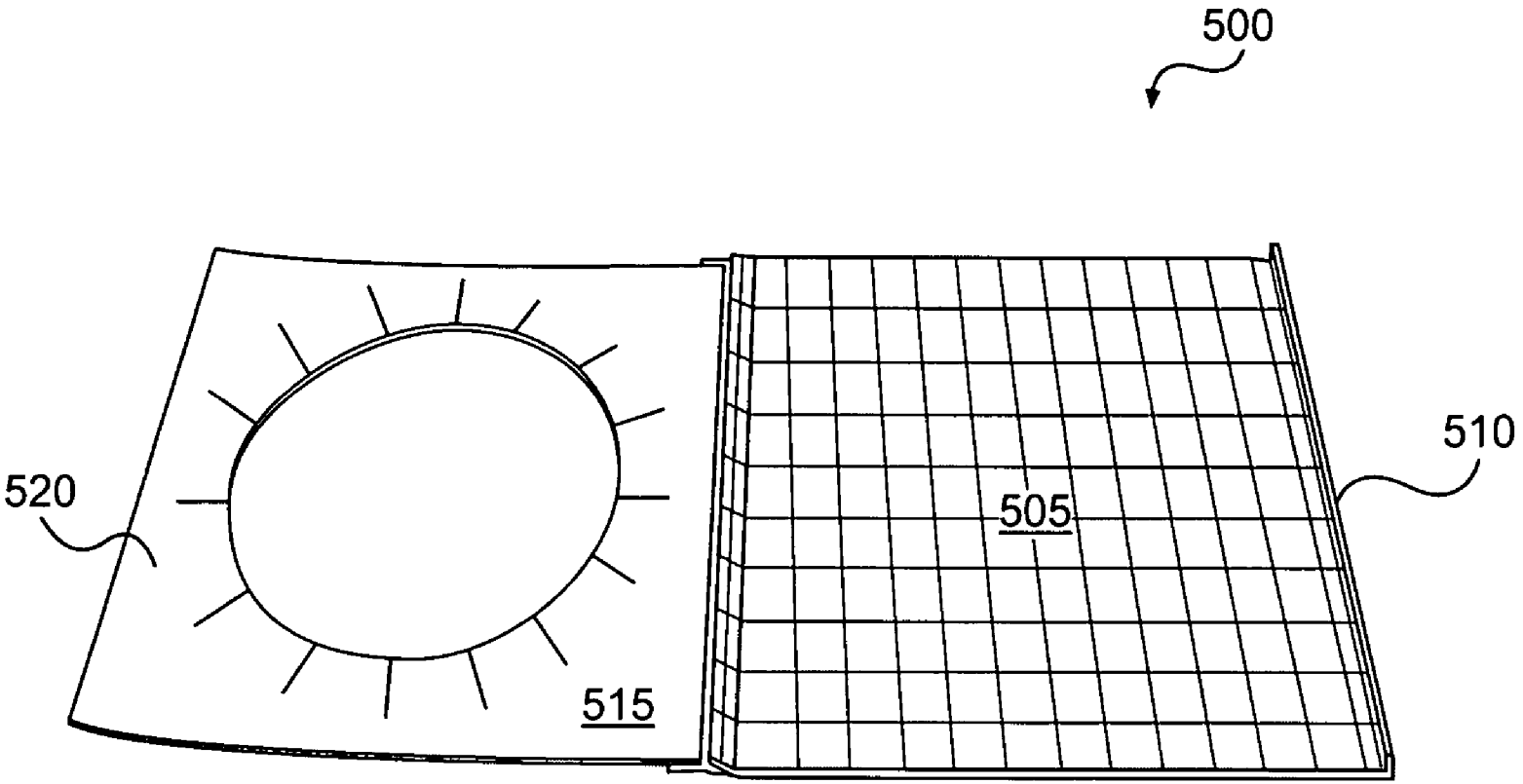
FIG. 10 depicts the construct of FIG. 9 including a susceptor and an insulating microwave material.

In the example shown in FIG. 7, the sleeve 300 includes an open first end 350 and an open second end 355 for sliding the food item F therein. In other aspects, the second end 355 may be sealed closed. Alternatively, as shown in FIG. 9, the cooking package may be provided as an unfolded blank 400 with a base panel 405, a cover panel 410, and a flap 415. In this example, a susceptor material 420 overlies the base panel 405 and the cover panel 410. To form a sleeve (e.g., as shown in FIG. 7), the user places the food item F (not shown) on the base 405, folds the cover 410 over the food item (not shown) so that flap 415 overlaps with the base 405, and secures the cover 410 to the base 405 using a locking means, for example, a tab and slot (not shown). As shown in FIG. 10, an insulating microwave material, such as QUILTWAVE® Focus susceptor material, may be used as needed or desired for a particular heating or cooking application. In the exemplary blank 500 of FIG. 10, the insulating microwave material 505 overlies the base panel 510 and a susceptor material 515 overlies the cover panel 520.

Figure 11:
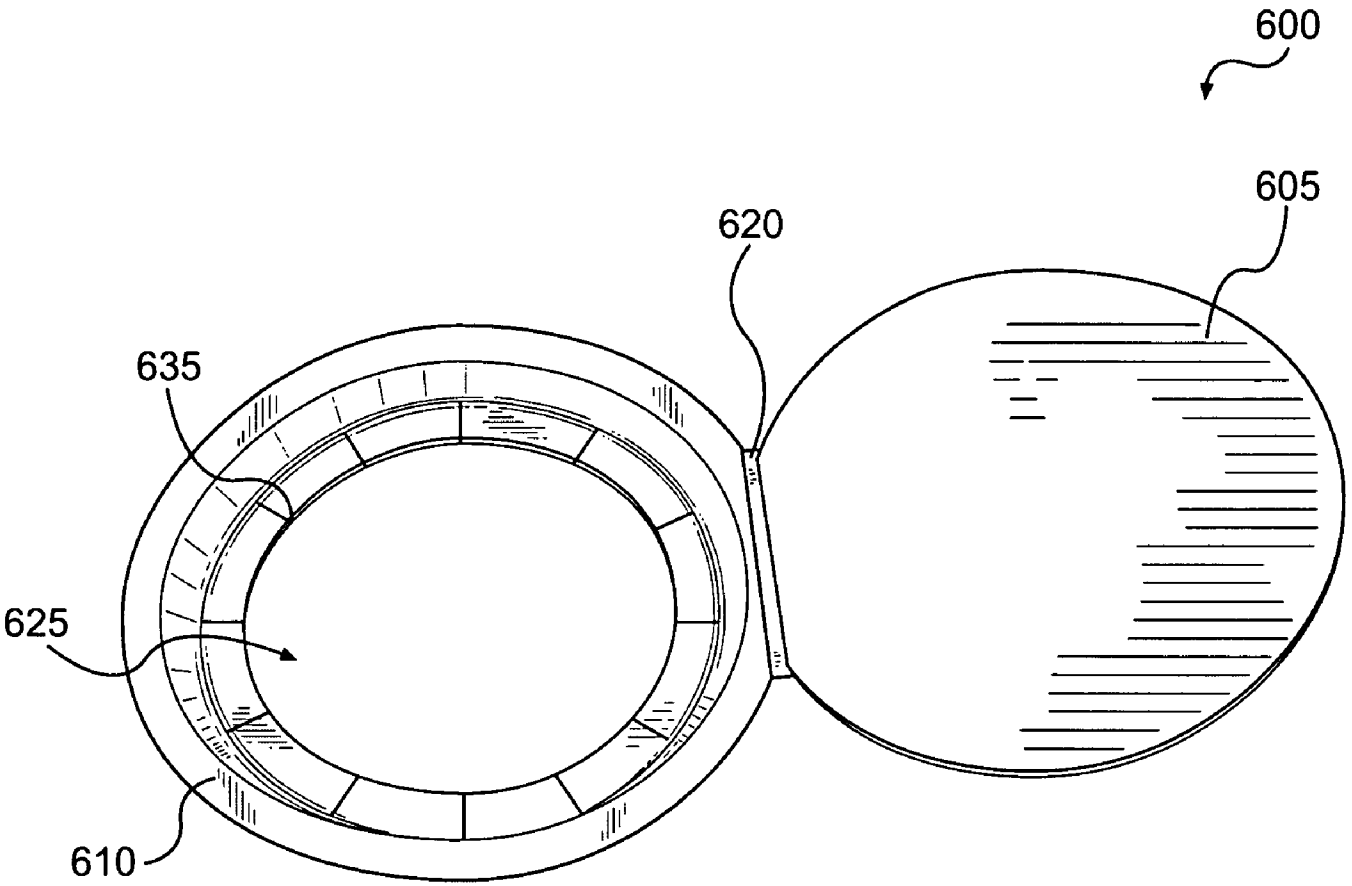
FIG. 11 depicts an exemplary microwave cooking construct according to various aspects of the present invention in the form of a tray.
Figure 12:
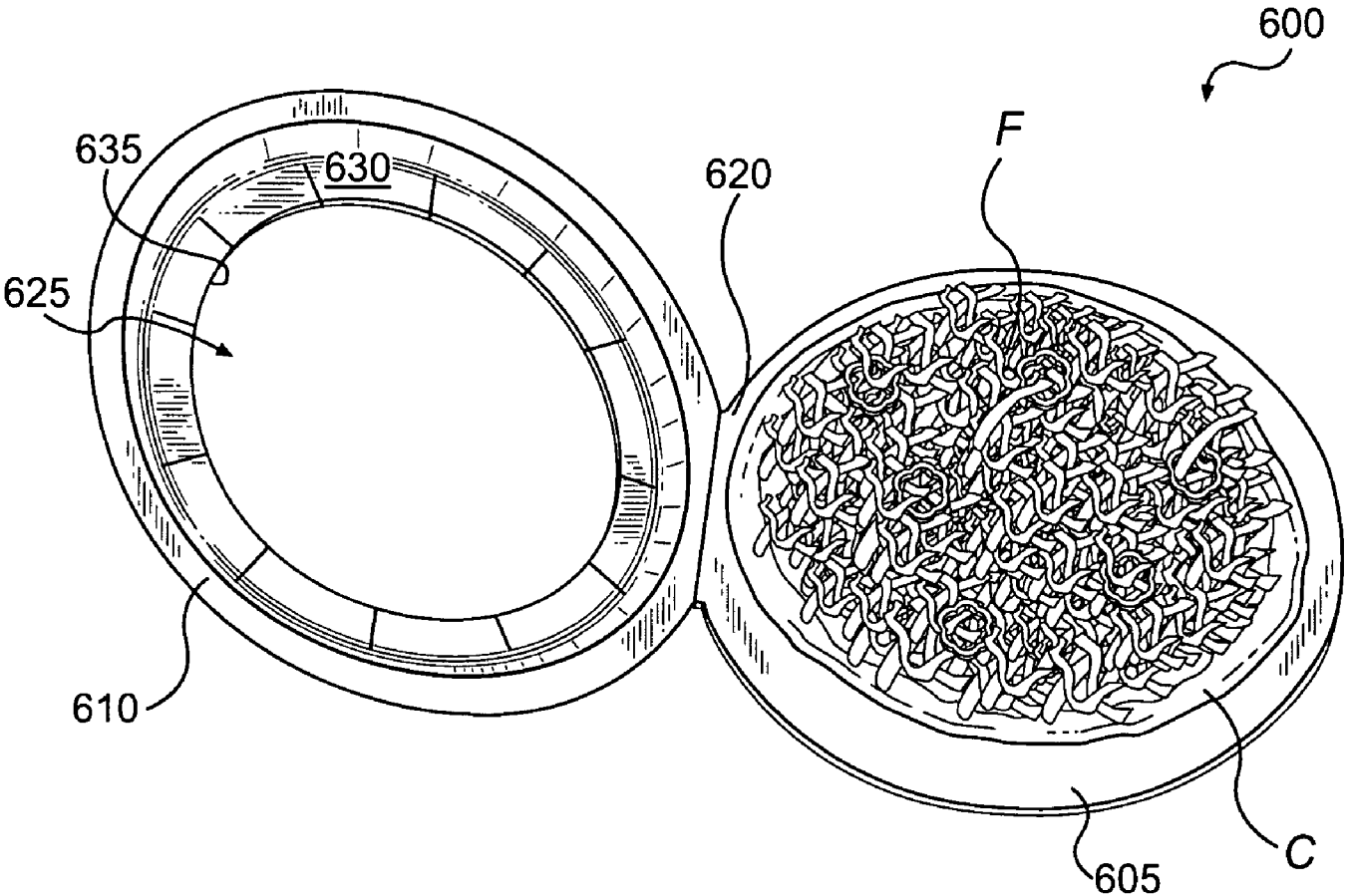
FIG. 12 depicts the tray of FIG. 11 in an open condition with a food item thereon.
Figure 13:
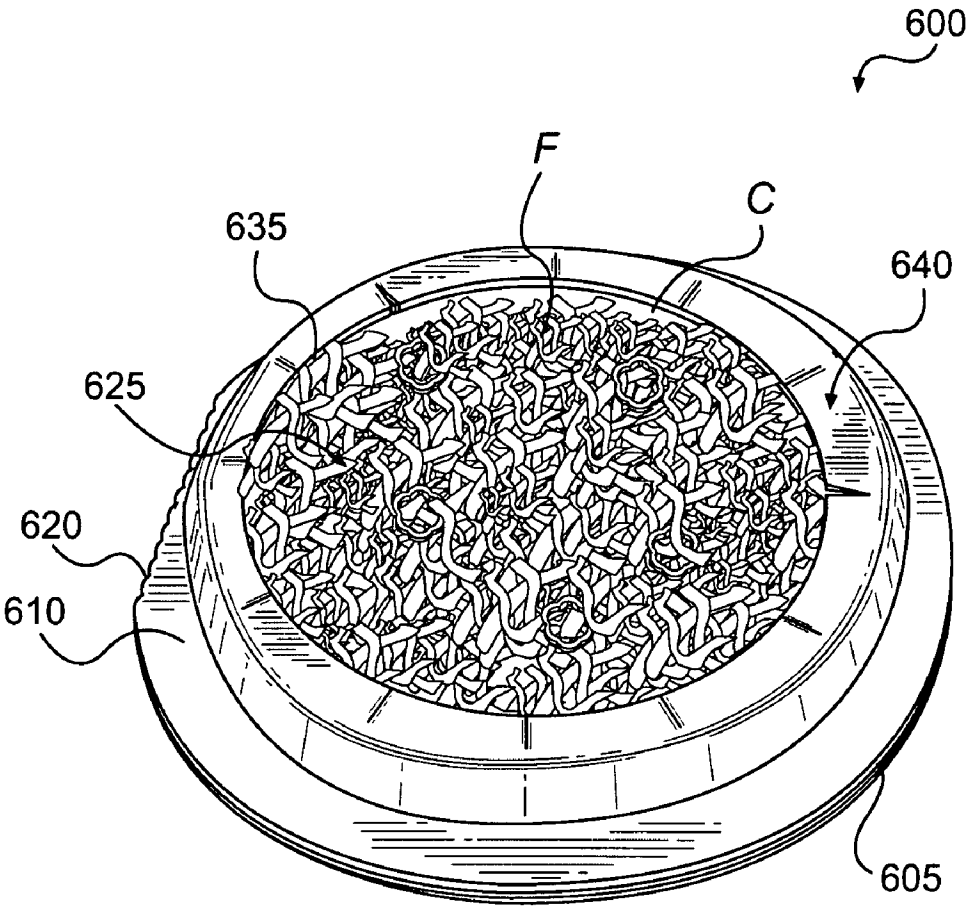
FIG. 13 depicts the tray of FIGS. 11 and 12 in a closed condition with a food item therein.

An alternate cooking package in the form of a tray 600 is provided in FIGS. 11-13. The tray 600 includes a generally circular base 605 and ring-shaped, domed cover 610 formed from a susceptor material laminated to paperboard. The cover 610 is attached hingedly to the base 605 by a fold line, perforations, flexible tape 620, or any other means that permits the cover 610 to rotate hingedly toward the base 605. The cover 610 includes a generally circular opening 625 that corresponds in size to the topped or filled portion of the food item F (best seen in FIGS. 12 and 13) and through which microwaves (not shown) directly impinge on the food item F during use. The cover 610 has a domed, three-dimensional shape having a inner surface 630 contoured to accommodate the shape of the crust C (best seen in FIG. 12), thereby allowing the susceptor material on the cover 610 to be in proximate and/or intimate contact with the crust C for enhanced browning and crisping. Optionally, the cover 610 may include a plurality of slits (not shown) extending outwardly from the inside edge 635 of the cover 610 toward the peripheral portion 640 that allow additional expansion of the dough as it rises.

It should be understood that while circular configurations are shown and described herein, other shaped food items and packages are contemplated by the present invention. Thus, for example, a square pizza and cooking package may be provided, and such package may include a square domed shaped cover and a square base.

FIGS. 12 and 13 depict the tray 600 during setup and use. In FIG. 11, the food item F, in this case a pizza, is placed on the base 605. The cover 610 then is brought into substantial contact with the base 605 (FIG. 13). If desired, a securing or locking means (not shown) may be provided to secure the cover 610 to the base 605.

Figure 14:
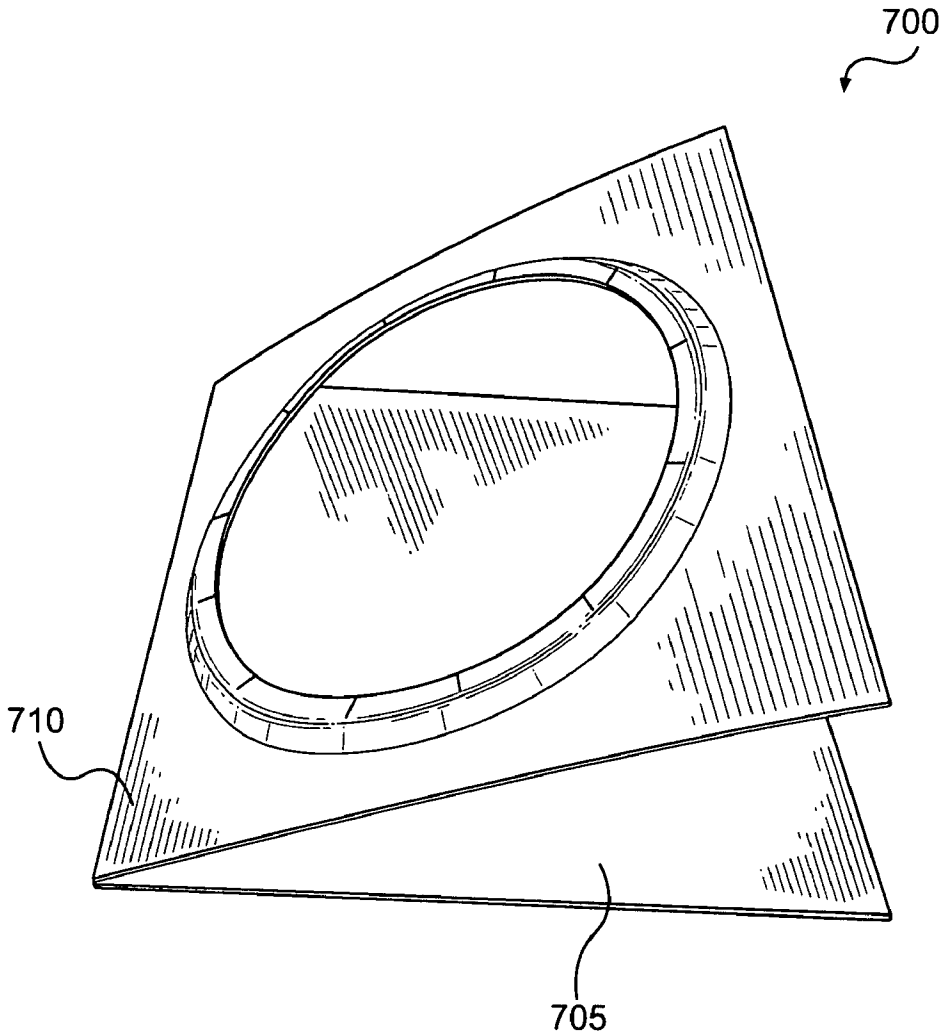
FIG. 14 depicts another exemplary construct according to various aspects of the present invention in the form of a tray having an overall square shape.

Another exemplary construct 700 is provided in FIG. 14. The construct 700 includes similar features as described in connection with FIG. 11, except that the base 705 and cover 710 have an overall square shape. Other shapes are contemplated by the present invention, provided that the tray is suitably dimensioned to fit in the typical range of consumer and commercial microwave ovens and accommodate the rotation of a turntable where applicable.

Figure 15:
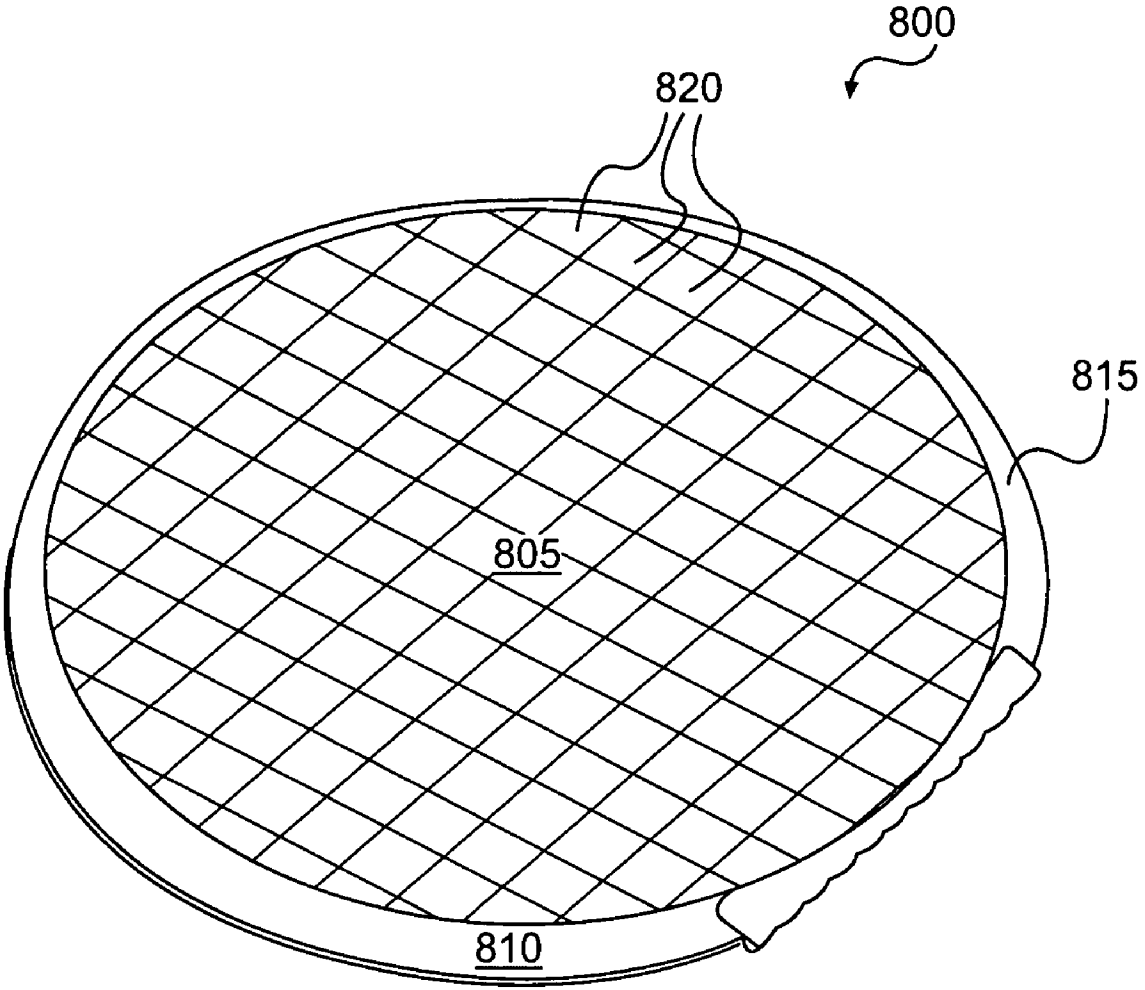
FIG. 15 depicts another exemplary construct according to various aspects of the present invention, with an insulating microwave material on the oven-contacting surface of the base.

Turning to FIG. 15, yet another exemplary tray 800 is illustrated. In this example, an insulating microwave material 805 overlies at least a portion of the bottom surface 810 of the base 815. As the cells 820 inflate during cooking, the tray 800 is elevated from the bottom of the microwave or from the turntable surface (not shown). This provides insulation and minimizes susceptor heat loss to the oven floor or turntable surface. As a result, the browning and crisping of the bottom of the food item is improved. Optionally, a susceptor material or another insulating microwave material may overlie at least a portion of the opposed (food-contacting) surface of the base 810.

Figure 16:
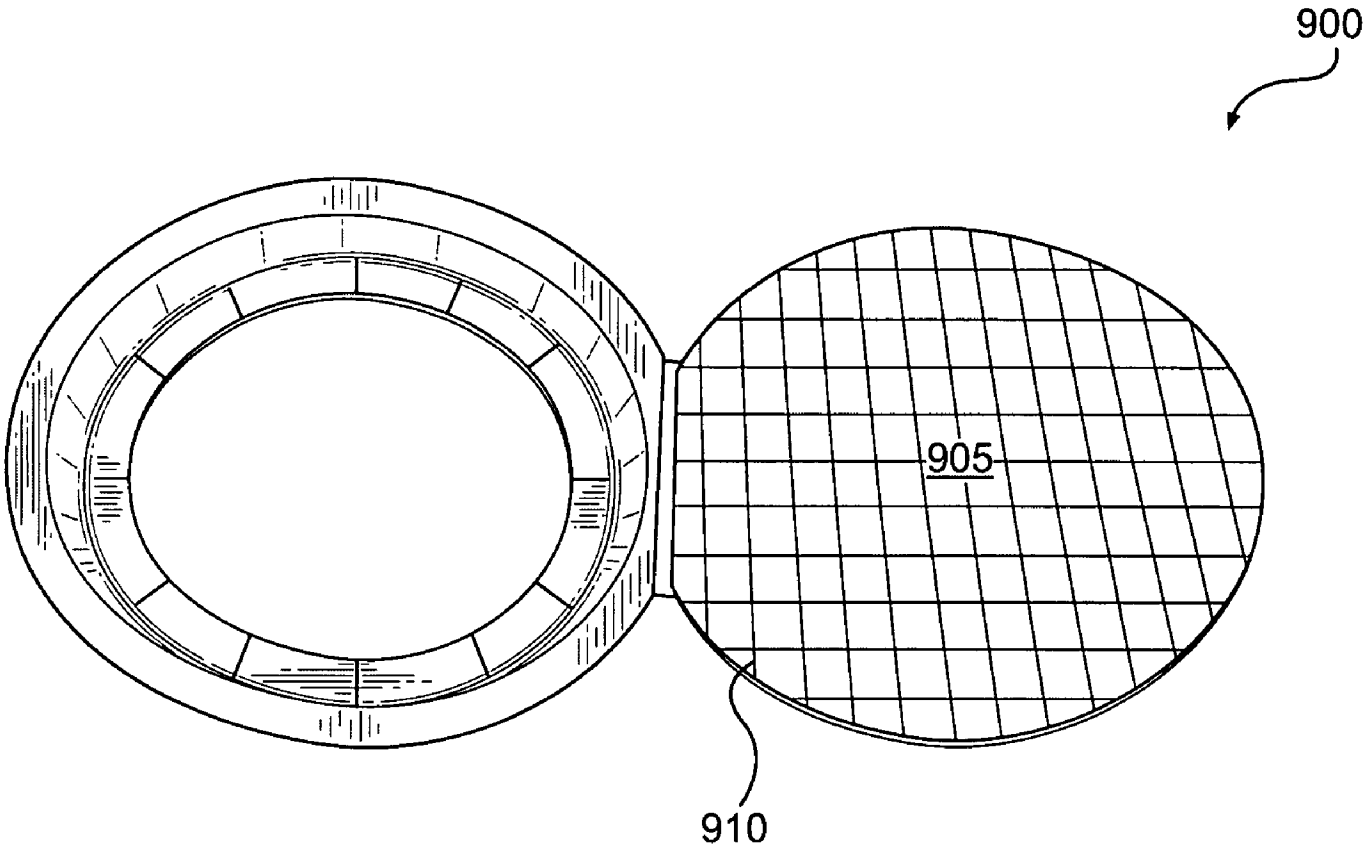
FIG. 16 depicts another exemplary construct according to various aspects of the present invention, with an insulating microwave material on the food-contacting surface of the base.

Alternatively or additionally, as shown in FIG. 16, the tray 900 may include an insulating microwave material 905, in this example, QUILTWAVE® Focus susceptor material, overlying at least a portion of the base 910 to elevate the food item (not shown) to achieve the desired degree of browning and crisping.

Figure 17:
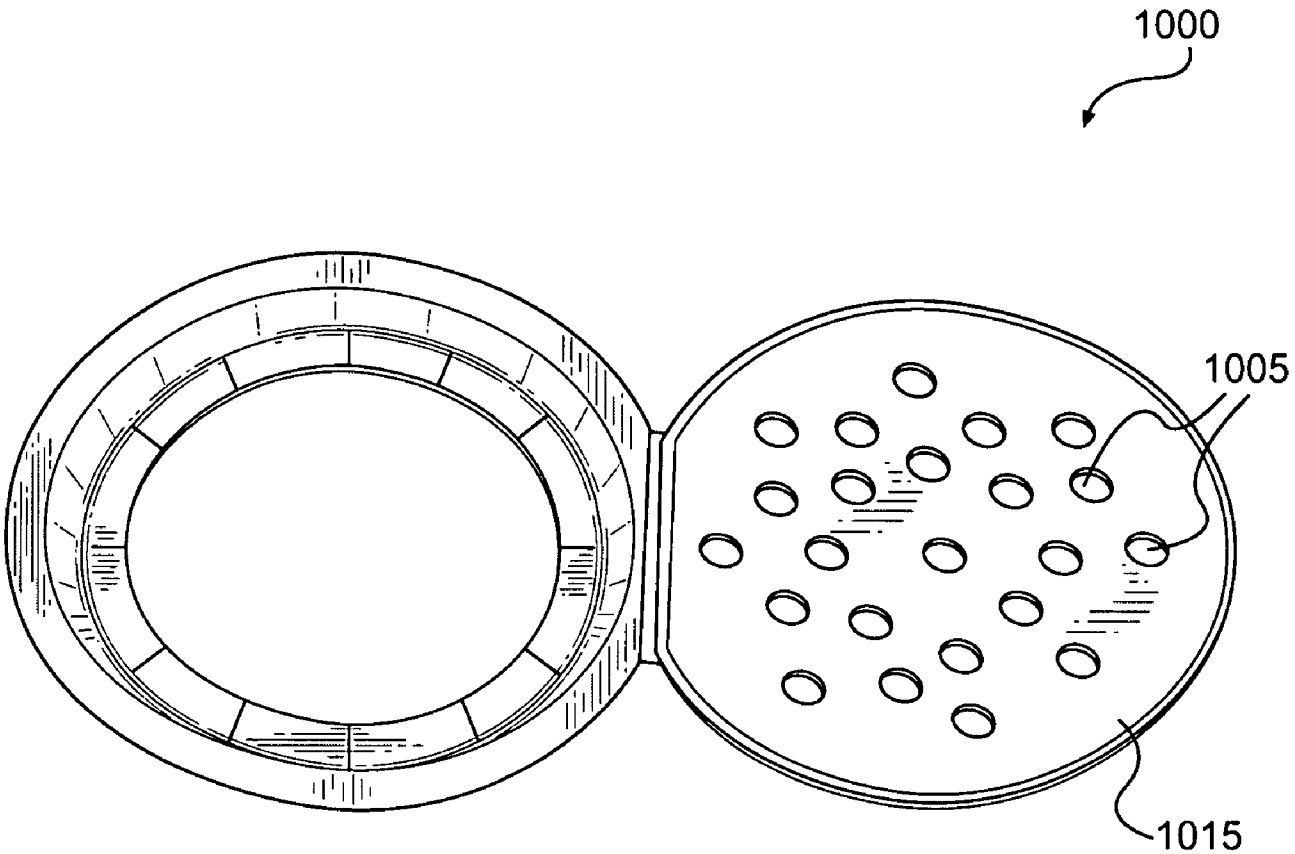
FIG. 17 depicts another exemplary construct according to various aspects of the present invention, with an apertured susceptor material on the food-contacting surface of the base.

Further, in still another exemplary tray 1000 depicted in FIG. 17, one or more apertures 1005 may be provided in a susceptor material 1010 overlying the base 1015. Various patterns may be provided as needed to enhance browning and crisping, as discussed above.

Figure 18:
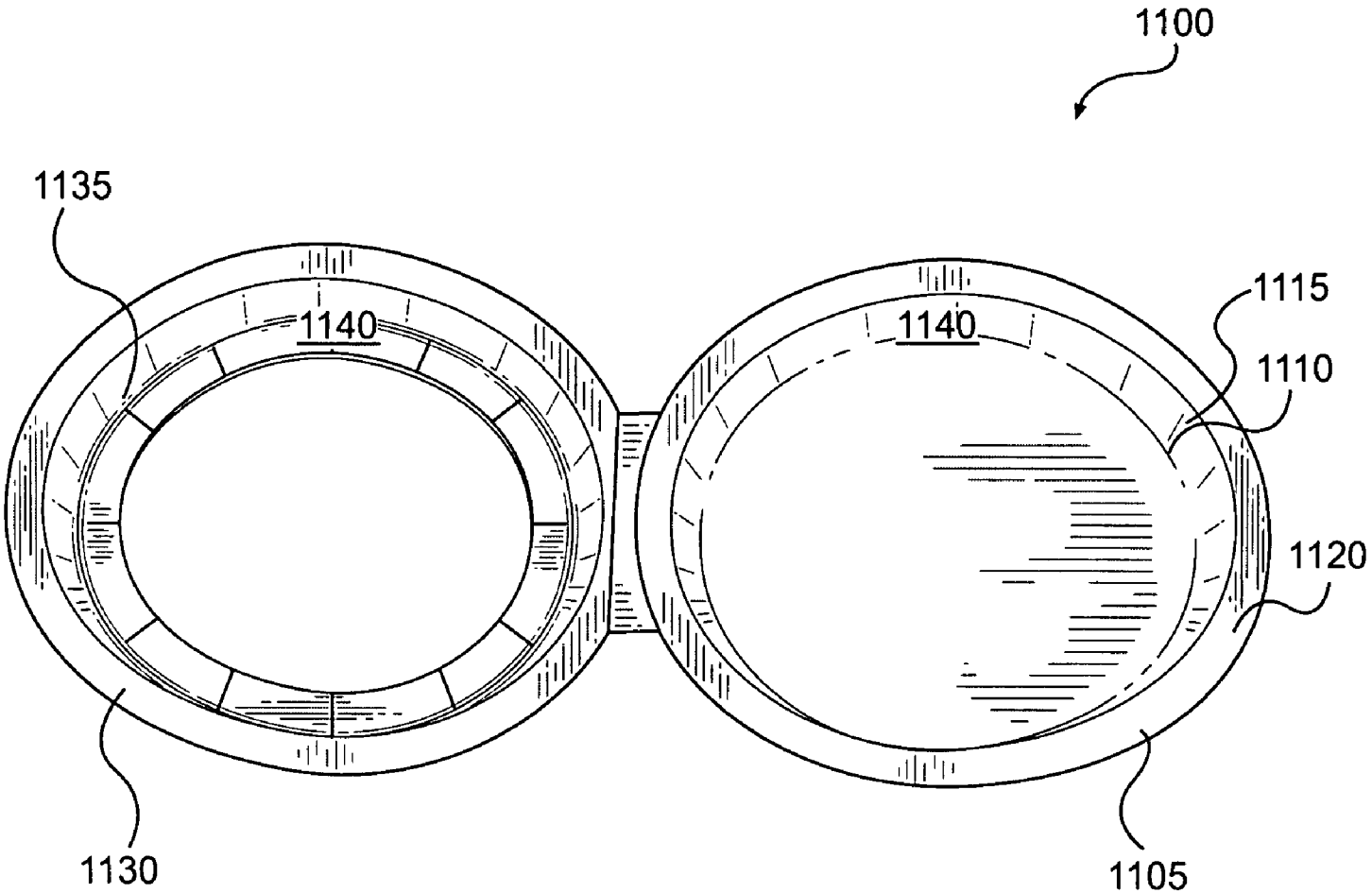
FIG. 18 depicts another exemplary construct according to various aspects of the present invention, in the form of a tray for use with a thicker food item.

FIG. 18 depicts still another exemplary tray 1100 for a deep dish pizza or other food item (not shown) that has a greater thickness. A "deep dish" pizza typically has a crust that is from about 13 to about 16 mm in thickness near the center of the pizza and from about 26 to about 32 mm in thickness near the crust, as compared with a "thin crust" pizza, which has a crust that is from about 2 to about 5 mm in thickness near the center and from about 4 to about 7 mm in thickness near the crust. The base 1105 includes a flattened bottom portion 1110 and a wall 1115 with a flange 1120 extending therefrom. The flange 1125 is adapted to contact a corresponding flange 1130 in the domed cover 1135. A susceptor material 1140 overlies the base 1105 and the cover 1135. If needed or desired, one or more apertures (not shown) may be provided in the base 1105 to permit moisture to vent from the tray.

It will be understood that the cooking package of the present invention provides numerous advantages over presently available packages. The unitary construction of the cooking package of the present invention allows a user to minimize the time required preparing the food item for cooking. It facilitates safe and convenient handling when removing hot food from the microwave oven, cutting it into portions, and serving it. Furthermore, the user is provided with a crisp, browned food item, even where a rising dough product is used.

Various aspects of the present invention may be understood further by way of the following example, which is not to be construed as limiting in any manner.

Example

A pizza was cooked for 5 minutes in a 1100 Watt Panasonic Model NN-S949 microwave oven. The cooked pizza was not suitably browned and crisped. The same type of pizza then was cooked for five minutes in the same microwave oven using the sleeve of FIG. 7. The crust and bottom of the pizza was suitably browned and crisp.

Although certain embodiments of this invention have been described above with a certain degree of particularity, those skilled in the art could make numerous alterations to the disclosed embodiments without departing from the spirit or scope of this invention. Any directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

While the present invention is described herein in detail in relation to specific aspects, it is to be understood that this detailed description is only illustrative and exemplary of the present invention and is made merely for purposes of providing a full and enabling disclosure of the present invention. It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

What is claimed is:

1. A construct for heating, browning, and/or crisping a food item in a microwave oven, the food item including a portion that is intended to be browned and/or crisped, the construct comprising:

a base for underlying the food item, the base including microwave energy interactive material supported on a first polymer film to define a susceptor film, a moisture-containing layer joined to the microwave energy interactive material of the susceptor film, and a second polymer film joined to the moisture-containing layer in a patterned configuration to define a plurality of expandable cells between the second polymer film and the moisture-containing layer; and a cover for overlying the food item, the cover having a generally annular shape that circumscribes a substantially circular opening of the cover, the cover being contoured so that the cover is for extending along an upper surface and a side surface of the food item, wherein the cover includes a substantially continuous peripheral portion pivotably connected to the base for pivoting the cover relative to the base between an open configuration and a closed configuration, a plurality of cuts extending from the opening to the substantially continuous peripheral portion, the cuts defining a plurality of tabs between the opening and the peripheral portion, wherein the tabs are configured for independently deflecting away from the base, and microwave energy interactive material, the microwave energy interactive material being operative for converting at least a portion of impinging microwave energy into thermal energy.

2. The construct of claim 1, wherein the portion of the food item intended to be browned and/or crisped comprises a dough that rises, the contoured portion of the cover is adapted to engage the dough, and the cover is adapted to pivot away from the base in response to a force exerted by the rising dough while remaining substantially engaged with the dough.

3. The construct of claim 1, wherein the portion of the food item intended to be browned and/or crisped comprises a dough that rises, and each tab is independently capable of deflecting away from the base in response to a deflecting force exerted by the rising dough.

4. The construct of claim 1, wherein in an initial configuration, the tabs are substantially coplanar with the opening, and in a deflected configuration, the tabs form an acute angle with respect to the opening.

5. The construct of claim 4, wherein in at least one of the initial configuration and the deflected configuration, the tabs are in intimate and/or proximate contact with the portion of the food item intended to be browned and/or crisped.

6. The construct of claim 1, further comprising a locking feature for releasably securing the cover to the base in the closed configuration.

7. The construct of claim 1, wherein the cover further includes a substantially planar portion circumscribing the contoured portion.

8. The construct of claim 7, wherein the substantially planar portion of the cover is for being adjacent to the base when the cover is in the closed configuration.

9. The construct of claim 1, wherein the microwave energy interactive material of the base is operative for converting at least a portion of impinging microwave energy into thermal energy.

10. The construct of claim 1, wherein the microwave energy interactive material of the base is disposed on a side of the base facing the cover when the cover is in the closed configuration.

11. The construct of claim 1, wherein the microwave energy interactive material of the base is disposed on a side of the base facing away from the cover when the cover is in the closed configuration.

12. The construct of claim 1, wherein the microwave energy interactive material of the base circumscribes a plurality of microwave energy transparent areas.

13. The construct of claim 1, wherein at least some of the expandable cells are operative for inflating in response to sufficient exposure to microwave energy.

14. The construct of claim 1, wherein the base is substantially planar.

15. The construct of claim 1, wherein the base includes a substantially planar bottom portion and a wall extending upwardly from a peripheral edge of the bottom portion.

16. The construct of claim 1, wherein the portion of the food item that is intended to be browned and/or crisped comprises at least one of the upper surface and the side surface of the food item.

17. A construct for heating, browning, and/or crisping a food item in a microwave oven, comprising:

a base for underlying the food item, the base comprising a susceptor film comprising microwave energy interactive material supported on a first polymer film, a moisture-containing layer joined to the microwave energy interactive material of the susceptor film, and a second polymer film joined to the moisture-containing layer in a patterned configuration to define a plurality of expandable cells between the second polymer film and the moisture-containing layer; and a cover for overlying the food item, the cover being pivotably connected to the base for being pivoted relative to the base between an open configuration and a closed configuration, the cover including an opening adapted to overlie a portion of the food item not intended to be browned and/or crisped, a contoured portion circumscribing the opening, the contoured portion being adapted to overlie a portion of the food item intended to be browned and/or crisped, and a microwave energy interactive material overlying an interior side of the contoured portion, the microwave energy interactive material being operative for converting at least a portion of impinging microwave energy into thermal energy.

18. The construct of claim 17, wherein at least some of the expandable cells are operative for inflating in response to sufficient exposure to microwave energy.

19. The construct of claim 17, wherein the base has a first side for facing the food item and a second side for facing away from the food item, and the plurality of expandable cells are disposed on the first side of the base.

20. The construct of claim 19, wherein the first polymer film is for contacting the food item.

21. The construct of claim 17, wherein the base has a first side for facing the food item and a second side for facing away from the food item, and the plurality of expandable cells are disposed on the second side of the base.

22. The construct of claim 21, wherein the second polymer film is joined to the second side of the base.

23. The construct of claim 17, wherein the susceptor film, moisture-containing layer, and second polymer film are disposed on the second side of the base, and the construct further comprises microwave energy interactive material joined to the first side of the base.

24. The construct of claim 23, wherein the microwave energy interactive material joined to the first side of the base circumscribes a plurality of microwave energy transparent areas.

25. The construct of claim 17, wherein the portion of the food item intended to be browned and/or crisped comprises a dough that rises, the contoured portion of the cover is for engaging the dough, and the cover is for pivoting away from the base in response to a force exerted by the rising dough.

26. The construct of claim 17, further comprising a plurality of slits in the contoured portion of the cover, wherein the slits extend inwardly from the opening to define a plurality of resilient, deformable tabs.

27. The construct of claim 26, wherein the tabs are operative for independently deflecting away from the opening.

28. The construct of claim 26, wherein the portion of the food item intended to be browned and/or crisped comprises a dough that rises, and the tabs are operative for independently deflecting away from the base in response to a force exerted by the rising dough.

29. The construct of claim 26, wherein in an initial configuration, the tabs are substantially coplanar with the opening, and in a deflected configuration, the tabs form an acute angle with respect to the opening.

30. The construct of claim 29, wherein in at least one of the initial configuration and the deflected configuration, the tabs are in intimate and/or proximate contact with the portion of the food item intended to be browned and/or crisped.

31. The construct of claim 17, further comprising a locking feature for releasably securing the cover to the base in the closed configuration.

32. The construct of claim 17, wherein the cover further includes a substantially planar peripheral portion circumscribing the contoured portion.

33. The construct of claim 17, wherein the base is substantially planar.

34. The construct of claim 17, wherein the base includes a substantially planar bottom portion and a wall extending upwardly from a peripheral edge of the bottom portion.

* * * * *